United States Patent [19]

Bell, Jr.

[11] 4,374,072

[45] Feb. 15, 1983

[54] REFLEX FAN CYLINDER FOR WATER COOLING TOWERS

[75] Inventor: Samuel W. Bell, Jr., Shawnee Mission, Kans.

[73] Assignee: Marley Company, Mission, Kans.

[21] Appl. No.: 298,086

[22] Filed: Aug. 31, 1981

[51] Int. Cl.[3] ..... F04D 29/54

[52] U.S. Cl. ..... 261/109; 261/DIG. 11; 165/DIG. 1; 415/207

[58] Field of Search ..... 261/109, DIG. 11, DIG. 77; 165/DIG. 1; 415/207, 219 R

[56] References Cited

U.S. PATENT DOCUMENTS

| | | | |
|---|---|---|---|
| 1,399,037 | 12/1921 | Uhde | 261/DIG. 11 |
| 1,497,408 | 6/1924 | Seelig | 415/207 |
| 3,780,999 | 12/1973 | Fordyce | 261/109 |
| 4,221,546 | 9/1980 | Papst et al. | 415/207 |

FOREIGN PATENT DOCUMENTS

| | | | |
|---|---|---|---|
| 631512 | 6/1936 | Fed. Rep. of Germany | 261/DIG. 11 |
| 2461982 | 10/1975 | Fed. Rep. of Germany | 165/DIG. 1 |
| 2360059 | 2/1978 | France | 261/109 |
| 600812 | 12/1959 | Italy | 165/DIG. 1 |
| 1322395 | 7/1973 | United Kingdom | 165/DIG. 1 |

*Primary Examiner*—Tim R. Miles

*Attorney, Agent, or Firm*—Schmidt, Johnson, Hovey & Williams

[57] ABSTRACT

An improved recovery fan cylinder for mechanical draft water cooling towers is provided which is configured with an upper reflex angle recovery section above the fan blade which gives unexpected increases in velocity head recovery as compared with conventional frustoconoidal stacks. The reflex stack hereof includes first and second superposed portions above the blade which are respectively oriented so that the external surfaces thereof cooperatively define a reflex angle; in preferred forms, the lower portion lies at an angle of from about 15° to 30° relative to the central upright stack axis, whereas the upper portion is oriented at an angle of 0°–10° on the same basis. Test evidence demonstrates that the stack of the invention permits unexpected reductions in fan horsepower, as compared with typical prior art stacks.

6 Claims, 2 Drawing Figures

REFLEX FAN CYLINDER FOR WATER COOLING TOWERS

BACKGROUND OF THE INVENTION

1. Field of the Invention

The present invention is concerned with velocity head recovery fan cylinders for use on water cooling towers in order to provide an increased measure of head recovery in the air currents drawn through and propelled from the tower, so that fan power requirements are lessened. More particularly, it is concerned with such a recovery fan cylinder which is configured such that the section thereof above the fan blade includes respective portions which are cooperatively configured to define therebetween a reflex angle of greater than 180°. Such a construction gives enhanced velocity head recovery and is therefore highly desirable.

2. Description of the Prior Art

Relatively large industrial sized induced draft water cooling towers of either the crossflow or counterflow variety have long been provided with velocity head recovery stacks which are mounted in circumscribing relationship to the powered fan(s) associated with the towers and extend upwardly therefrom. The purpose of such stacks is twofold. First, such stacks serve to discharge and guide hot exhaust air to a position above the tower where it diffuses into the ambient atmosphere and is carried away from the cool air inlet of the tower by the prevailing winds. It is necessary to discharge hot discharge air at an elevation where recirculation of such air back through the cool air inlets of the tower is prevented, since recirculation measurably lowers cooling efficiency. Second, stacks lessen fan horsepower requirements by virtue of "recovery" of pressure of air discharged therethrough, such occurring because of the diverging contour of the stacks.

Recovery stacks are generally configured with a venturi-like restriction intermediate the ends thereof which surrounds as closely as possible the fan blade, along with a divergent upper discharge section above the fan blade in which reduction in air velocity and partial recovery of pressure occurs. As noted, such a stack configuration serves to lessen fan power requirements, and in large towers the savings can be significant.

A typical prior art velocity head recovery stack is disclosed in U.S. Pat. No. 3,780,999. As illustrated in this patent, the stack includes an eased inlet section, a venturi-like intermediate fan-receiving section, and a divergent recovery section thereabove. Experience with prior stacks of this type has demonstrated that the most efficient recovery obtains when the tubular sidewall above the fan blade diverges at a substantially constant angle of 7.5° relative to the central axis of the stack. Although from a theoretical standpoint greater angles of divergence should be more effective, in practice it has been found that significantly larger angles of divergence in such conventional stacks results in unacceptable inefficiencies, stemming from frictional losses and the inability of air leaving the fan to adequately fill the relatively large stack volume prior to discharge to the atmosphere.

Those skilled in the art will readily appreciate that any improved stack design leading to enhanced velocity head recovery would be a major breakthrough in the art. This is particularly the case in view of spiralling energy costs, and the fact that an improved stack design could potentially aid in lowering such costs.

SUMMARY OF THE INVENTION

The present invention is directed to an improved velocity head recovery fan stack comprising an open ended body having an upright central axis and generally tubular wall sections respectively defining a fan-receiving section (usually of restricted diameter) and a recovery section above the fan-receiving section. The specific improvement resides in the configuration of the upper wall section such as to present first and second superposed portions. The first portion diverges outwardly from the stack axis at a first angle relative thereto, while the second portion is oriented at an angle relative to the first portion. The angle cooperatively defined between the exterior surfaces of the first and second portions is a reflex angle, i.e., between 180° and 360°.

The preferred fan stack further includes a lowermost eased inlet section below the fan-receiving section and which is divergent relative to the latter.

It has been found that in order to maximize recovery with a stack in accordance with the invention, the defined reflex angle should be from about 185° to 210°. Correspondingly, the first angle (that of the first divergent portion relative to the stack axis) should be from about 15° to 30°, and most preferably about 20°. By the same token, the second portion of the recovery section should be oriented at a second angle relative to the stack axis, advantageously from about 0°–10°, and most preferably about 5°.

DESCRIPTION OF THE PREFERRED EMBODIMENT

Figure 1:
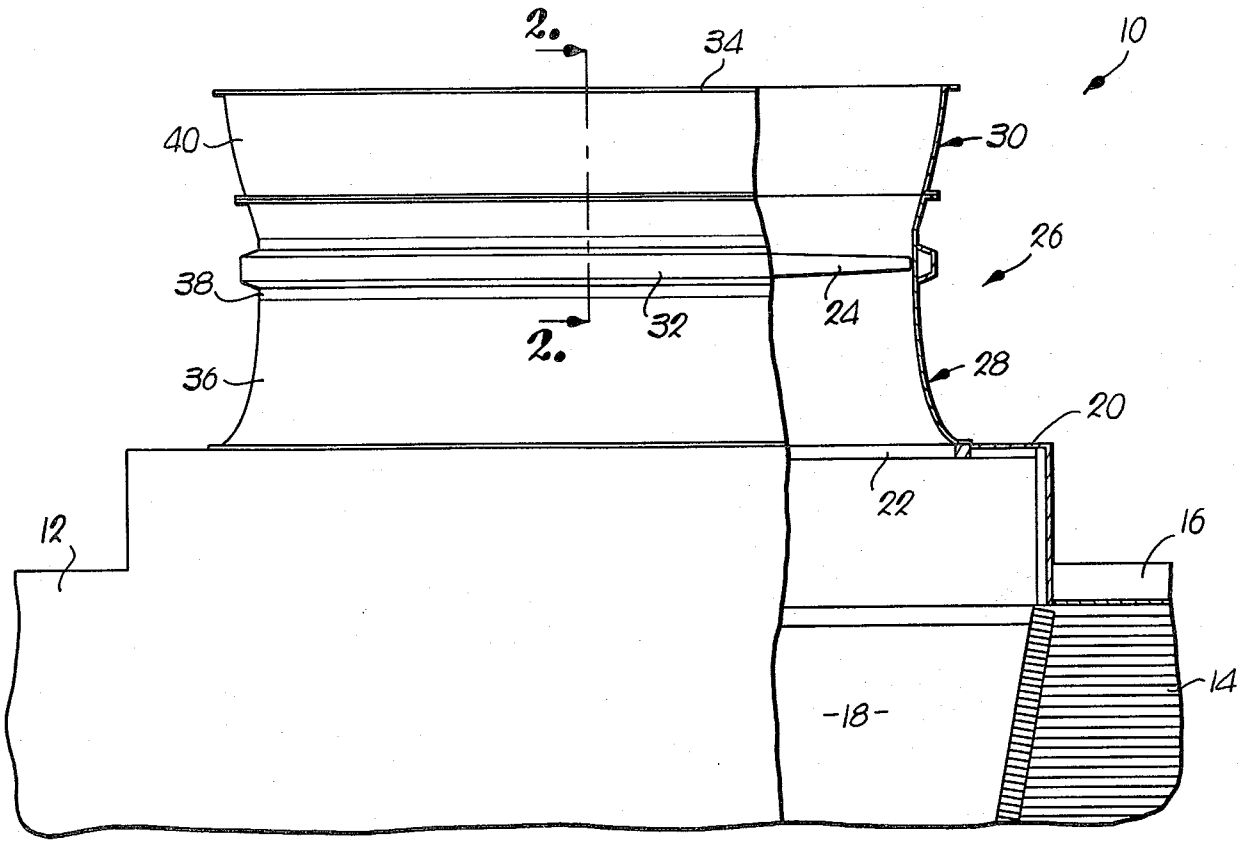
FIG. 1 is a fragmentary view in partial vertical section illustrating an induced draft crossflow water cooling tower, equipped with a fan stack in accordance with the invention.

Referring now to the drawing, an induced draft crossflow water cooling tower 10 is illustrated in FIG. 1 and includes a pair of opposed, spaced apart fill sections 12, 14 provided with corresponding overlying hot water distribution basins 16, along with structure defining a central plenum chamber 18 between the fill sections 12, 14. An apertured deck 20 overlies the chamber 18, and is provided with one or more circular openings 22 therein. A fan blade 24, rotatable about an upright axis, is disposed above each opening 22, and is powered for rotation by conventional motive means (not shown).

A fan stack 26 is associated and in registry with each opening 22, is secured to and extends upwardly from the deck 20, and circumscribes the corresponding fan blade 24. The stack 26 is in the form of an upright, open ended body presenting an upright central axis. In the form shown, the stack is comprised of aligned, interconnected, tubular elements 28, 30, with the lower element 28 being provided with an external circumscribing reinforcing ring 32. The uppermost end of element 30 is provided with a radially outwardly extending lip 34 as shown.

The overall stack body made up of the elements 28, 30, effectively presents three sections, namely, a lowermost eased inlet section 36, an intermediate fan-receiving section 38, and an upper recovery section 40. The inlet section 36 converges inwardly from the periphery of opening 22 (see FIG. 1) and assures that air enters the stack 26 with a minimum of turbulence. The fan-receiving section 38 is generally in the form of a constant diameter tubular section which merges into the upper end of the section 36. It will be noted in this regard that the section 38 effectively presents a venturi-like constriction and is closely adjacent the fan blade tips, so that fan efficiency is maximized.

Figure 2:
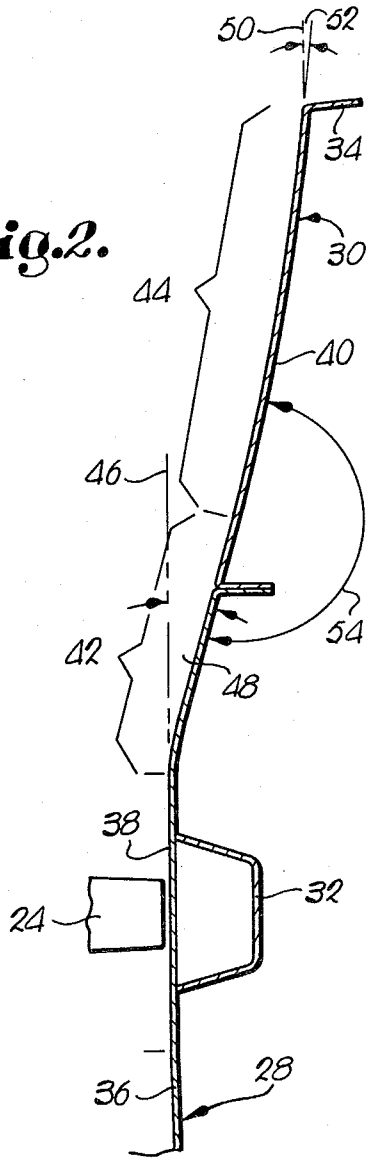
FIG. 2 is an enlarged vertical sectional view taken along line 2—2 of FIG. 1 which further illustrates the details of construction of the preferred fan stack.

The recovery section 40 can best be thought of as comprising first and second portions 42, 44, illustrated by means of corresponding brackets in FIG. 2. It will be noted that the portion 42 diverges outwardly from the central axis of the fan stack (and thereby equally from vertical reference line 46) by an angle 48; this angle advantageously varies from about 15° to 30°, and most preferably is about 20°.

The second portion 44 above portion 42 diverges to a lesser extent, as compared with the first portion. In this case, the portion 44 is oriented relative to the central fan axis (and thereby relative to vertical reference line 50) by an angle 52. This angle 52 should be up to about 10° (e.g. 0°–10°), and most preferably about 5°.

The angular relationships described above with reference to the portions 42, 44, serve to define therebetween an exterior reflex angle 54 (see FIG. 2) between the portions. That is to say, the reflex angle is defined between the exterior surfaces of the first and second portions 42, 44. This reflex angle should be from about 185° to 210°.

Actual tests with the preferred stack 26 demonstrate that enhanced recoveries are obtained. Specifically, and referring to the following table, percentage reductions in fan horsepower were observed in a modeled test when using reflex angle stacks in accordance with the invention, as compared with prior 7.5° straight divergent frustoconoidal stack. The fan employed had a diameter of three feet and the recovery section of each test stack was 10.6 inches. The only difference between the stacks was therefore the configuration of the respective stack recovery sections. In the table, the 15° and 20° headings refer to the angle 48 described above, and in both cases the angle 50 of the tested stacks was 5°. Tests were run at three separate airflow levels, and at three different levels of total head, measured just above the fan blade within the stacks. In all cases, the stacks of the invention resulted in reductions in fan horsepower.

TABLE

| | .45 in. $H_2O$ | | .35 in. $H_2O$ | | .25 in. $H_2O$ | |
|---|---|---|---|---|---|---|
| | 15° | 20° | 15° | 20° | 15° | 20° |
| 9,000 CFM | .6[1] | 1.8 | 1.3 | 1.8 | .7 | 1.0 |
| 11,000 CFM | 1.9 | 3.2 | 2.6 | 3.7 | 3.0 | 1.6 |
| 13,000 CFM | 2.6 | 3.8 | 3.2 | 3.8 | 3.5 | 1.7 |

[1]Percentage reduction in horsepower as compared with conventional recovery stack.

The foregoing results are extremely surprising in view of the fact that the initial angle of divergence above the fan in the configuration of the stacks hereof should, on the basis of prior experience and published information, lead to a lowering of recovery and hence greater horsepower requirements. That is to say, such considerations dictate that, for maximum effectiveness, a fan stack should be uniformly outwardly divergent at an included angle ideally no more than 15° above the fan. However, as demonstrated by the foregoing results, better recovery is actually obtained with a stack construction in accordance with the invention.

I claim:

1. In a fan assembly for a water cooling tower having a fan blade rotatable about an upright axis, the combination with said blade of an upright, open-ended tubular body coaxial with the fan in surrounding relationship thereto and provided with a lower, generally cylindrical wall section aligned with and receiving the fan blade, said lower blade-receiving wall section having an effective height at least equal to the effective cross-sectional height of the area occupied by the fan blade during rotation thereof, said tubular body further being provided with a reflex recovery wall section joined to and extending upwardly from the lower blade-receiving wall section, said recovery wall section having a lower, tubular portion projecting upwardly from the blade-receiving wall section and diverging outwardly from the cylindrical blade-receiving wall section above the fan blade at a first angle relative to the blade-receiving wall section and thereby the axis of rotation of the fan blade, the recovery wall section being provided with a second tubular portion projecting upwardly from the lower tubular portion thereof and configured such that the second wall portion is at a second angle relative to the first portion which is a different angle relative to the axis of rotation than the angularity of the first tubular portion with respect to such axis, the angularity of the first wall portion with respect to said axis being greater than the angularity of the second wall portion to such axis, said first angle being from 15° to 30° and the second angle being up to about 10°.

2. Apparatus as set forth in claim 1 wherein said first angle is about 20°.

3. Apparatus as set forth in claim 1 wherein said second angle is about 5°.

4. Apparatus as set forth in claim 1 wherein said first and second wall portions are configured and arranged such that the reflex angle of the merger of said first and second angles defined thereby is from about 180° to 210°.

5. Apparatus as set forth in claim 1 wherein said tubular body is provided with a lowermost eased inlet section joined to and extending downwardly from the blade-receiving wall section.

6. Apparatus as set forth in claim 1 wherein is provided a reinforcing ring disposed about said lower wall section.

* * * * *